US006146712A

United States Patent [19]

Maeda et al.

[11] Patent Number: 6,146,712

[45] Date of Patent: Nov. 14, 2000

[54] INK-JET RECORDING SHEET AND PROCESS FOR PRODUCING THE SAME

[75] Inventors: Masayo Maeda, Kawasaki; Kozo Tajiri, Tokyo, both of Japan

[73] Assignee: OJI Paper Co., Ltd., Tokyo, Japan

[21] Appl. No.: 09/199,781

[22] Filed: Nov. 25, 1998

[30] Foreign Application Priority Data

Nov. 26, 1997 [JP] Japan ..... 9-324363
Dec. 22, 1997 [JP] Japan ..... 9-353105

[51] Int. Cl.[7] ..... B05D 3/06
[52] U.S. Cl. ..... 427/493; 427/496
[58] Field of Search ..... 427/493, 496

[56] References Cited

FOREIGN PATENT DOCUMENTS

| | | |
|---|---|---|
| 1-229685 | 9/1989 | Japan . |
| 6-155895 | 6/1994 | Japan . |
| 7-195827 | 8/1995 | Japan . |
| WO 96/29205 | 9/1996 | WIPO . |

OTHER PUBLICATIONS

Patent Abstract of Japan, vol. 013, No. 555 (M–904), Dec. 11, 1989, JP 01 229685, Sep. 13, 1989.
Patent Abstract of Japan, vol. 011, No. 155 (M–589), May 20, 1987, JP 61 284483, Dec. 15, 1986.

*Primary Examiner*—Erma Cameron
*Attorney, Agent, or Firm*—Oblon, Spivak, McClelland, Maier & Neustadt, P.C.

[57] ABSTRACT

The present invention provides an ink-jet recording sheet which is excellent in water resistance, capable of providing excellent ink-drying property and image quality, substantially free from blurring, and suitable for use as OHP sheets of which a high transparency is necessitated. The present process for producing an ink-jet recording sheet comprises applying to a base sheet, an aqueous solution of a water-soluble resin having no radically polymerizable double bond in the molecule and selected from the group consisting of polyvinyl alcohol, polyvinyl pyrrolidone, polyacrylamide, polyacryloyl morpholine, water-soluble polyvinyl acetal, poly-N-vinyl acetamide, hydroxyethyl cellulose, hydroxypropyl cellulose, methyl cellulose, hydroxypropyl methyl cellulose, hydroxyethyl methyl cellulose, gelatin, casein and derivatives of them, irradiating the resultant coating layer with electron beam before the coating layer is dried, to form a hydrogel, and drying the hydrogel. In the present invention, the water-soluble resin is usable in combination with a polyalkylene oxide compatible with the water-soluble resin.

14 Claims, No Drawings

INK-JET RECORDING SHEET AND PROCESS FOR PRODUCING THE SAME

TECHNICAL FIELD OF THE INVENTION

The present invention relates to a recording sheet for an ink-jet printer using an aqueous ink. In particular, the present invention relates to an ink-jet recording sheet suitable for an OHP sheet of which a high transparency is necessitated.

BACKGROUND ART OF THE INVENTION

Various output methods such as wire-dot recording method, thermal recording method, melt thermal transfer recording method, sublimating dye transfer recording method, electrophotographic method and ink-jet recording method have been developed for the output of computers or the like. Among them, the ink-jet recording method is recognized as a method suitable for a personal use because a plain paper is used as the recording sheet, the running cost is low and the hard ware is compact and inexpensive. Further, since full-color technique and high resolution have been attained recently, the ink-jet recording method has lately attracted attraction as an easy output means and is now being widely spread.

Overhead projectors (hereinafter referred to as "OHP") are widely used for conferences and lectures. Recently, it is demanded to use a color OHP, and investigations have been made on ink-jet recording sheets for OHP.

The recording sheets for OHP are transparent films made of a polyethylene terephthalate or the like and each having a transparent ink-receiving layer. Since an ink prepared by dissolving a dye, an organic solvent, an additive, etc. in water is used for the ink-jet recording method, most recording sheets for OHP each comprises a transparent film having an ink-receiving layer made of a water-soluble polymer such as a polyvinyl alcohol, polyvinylpyrrolidone, water-soluble cellulose derivative or gelatin. Those recording sheets are available on the market.

The properties required of the ink-receiving layer are as follows: minute letters or images can be reproduced; the images have high color densities and the faithful color tone thereof is reproduced; the rapid drying is possible after the printing; the printed image does not fade during the storage; and even when a pile of the printed matters is stored, no blocking is caused.

It is also demanded that the recording sheets are free from adhesion under a high humid condition and that they have a high water resistance so that even when the sheets are brought into contact with water, the printed surfaces are not dissolved therein or the printed letters and images are not blurred. However, it is a very difficult problem to impart the water resistance to the ink-receiving layer. The above-described ink-receiving layer made of the water-soluble polymer has no water resistance at all because this substance is essentially soluble in water. It is an ordinary technique to cross-link the water-soluble polymer with a cross-linking agent to improve the water resistance. However, the inventors have found after investigations that when, the water resistance is to be imparted to the ink-receiving layer by insolubilizing the water-soluble polymer by cross-linking it, the obtained layer becomes to adsorb the ink not so much and the quality of the obtained image is seriously impaired. Even though the cross-linking must be weakened to keep a high quality of the image, the water resistance becomes insufficient in such a case. This phenomenon occurs irrespective of the kinds of the cross-linking agents.

Several methods of imparting water resistance to the ink-receiving layer without the cross-linking were proposed.

For example, a method wherein a hydrophilic polymer is mixed with a lipophilic polymer is proposed in Japanese Patent Unexamined Published Application (hereinafter referred to as "J. P. KOKAI" No. Sho 57-102391. However, this method has a problem in that since the hydrophilic high-molecular substance is not highly compatible with the lipophilic high-molecular substance, the transparency of the ink-receiving layer is reduced. Japanese Patent Publication for Opposition Purpose (hereinafter referred to as "J. P. KOKOKU") No. Hei 5-23597 discloses a polyvinyl acetal resin for the ink-jet recording sheets. This method is free from the problem of the compatibility unlike that of J. P. KOKAI No. Sho 57-102391 because a high-molecular chain has both hydrophilic functional group and lipophilic functional group, and is characterized in that a transparent ink-receiving layer having a high water resistance can be obtained. However, this resin for the ink-jet method has a defect in that since it is not soluble in water, it must be dissolved in a mixture of water and an organic solvent before the application to the sheet. Another problem of this resin is that a relatively long time is necessitated for drying the ink.

Further, a method wherein active energy rays such as electron beam and ultraviolet rays are used was also proposed. For example, J. P. KOKAI No. Hei 1-229685 discloses an ink-jet recording sheet having a receiving layer having a high water resistance, which is prepared by cross-linking a composition comprising a water-soluble resin, polyethylene glycol di(meth)acrylate and water as the indispensable components with active energy rays. J. P. KOKAI No. Sho 62-94380 discloses an ink-jet recording sheet having an ink-receiving layer prepared by curing a resin composition containing a cationic synthetic resin having a photo-polymerizable double bond, which is cured by the active energy ray. J. P. KOKAI No. Hei 1-286886 discloses an ink-jet recording sheet having an ink-receiving layer prepared by curing an ionizing radiation-curable hydrophilic monomer and/or hydrophilic oligomer in the form of a solution thereof in a solvent by the irradiation with the ionizing radiation. It is common in these prior techniques that the composition containing a double bond which is radical-polymerizable with the active energy ray is applied to a base sheet and then the polymerization and cross-linking are conducted by the irradiation of the active energy ray to form the ink-receiving layer. Although the receiving layer having a high water resistance can be surely obtained by these methods, the image quality obtained by printing with an ink-jet printer is low disadvantageously. Reasons therefor are supposed to be that the cross-linking density is easily increased and that the intended polymer of a high molecular weight cannot be easily obtained because the polymerization time is short.

It is also known to form a receiving layer of a high water resistance by cross-linking a double bond-free resin composition by the irradiation with the active energy ray. For example, J. P. KOKAI No. Hei 7-81211 contains an Example wherein a solution containing only a water-soluble polymer is applied to a base sheet and, after drying, it is irradiated with an electron beam to form the receiving layer. However, after investigations, the inventors have found that the kind of the water-soluble resins which can be cross-linked and water-insolubilized by the irradiation of the electron beam of as small as about 10 Mrad is limited to a very small range and that to sufficiently conduct the cross-linkage, it is necessary to also use a radical-reactive hydrophilic monomer or to also introduce a radical-reactive unsaturated group into the water-soluble polymer when the sufficient cross-linkage is to be conducted.

J. P. KOKAI No. Hei 8-267905 discloses a receiving layer of double layer structure prepared by forming an electron beam-cured inner layer comprising a polyvinyl pyrrolidone and an aqueous electron beam-curable compound as main components on a base sheet, applying an aqueous solution of a water-soluble polyalkylene oxide thereto, irradiating the formed solution layer with electron beam before it is dried, and drying the solution layer to form an outer layer. Although the ink-jet recording sheets having a high water resistance and being capable of providing an excellent image quality can be obtained by this method, it has a defect of a low productivity because the coating and the irradiation with electron beam must be conducted twice. In addition, the polyalkylene oxides have a problem of causing "blurring" of the image.

SUMMARY OF THE INVENTION

Therefore, the object of the present invention is to provide a recording sheet for an ink-jet printer, which is suitable for use particularly as OHP sheets of which a high transparency is necessitated.

Another object of the present invention is to provide an ink-jet recording sheet excellent in water resistance, capable of providing excellent an ink-drying property and image quality, substantially free from blurring and suitable for use as OHP sheets of which a high transparency is necessitated.

Namely, after intensive investigations made for the purpose of solving the above-described problems, the inventors have found specific kinds of water-soluble resins capable of forming a hydrogel by the irradiation of electron beam while it is wet, although the water resistance thereof is scarcely improved by the irradiation of dry coated films of them with electron beam. The inventors have also found that when the hydrogel thus obtained is dried, an ink-receiving layer having a high water resistance and capable of realizing a high image quality can be obtained. The inventors have further found that when the water-soluble resin forming the hydrogel is cationic, excellent characteristics can be obtained. Namely, in this case, the dye in the ink is electrostatically reacted with the cationic group and thereby fixed and, as a result, the set off is only slight and the dye is not eluted in water even when the paper is immersed in water. The inventors have found that when the water-soluble resin is used in combination with a polyalkylene oxide compatible with this resin, a further improved image quality can be obtained even with the latest ink-jet printer which jets a large amount of the ink and, in addition, the drying time of the receiving layer thus obtained is reduced. The present invention has been completed on the basis of these findings. In particular, although it is known that the polyalkylene oxides are capable of providing a high image quality and a sufficient ink-drying property, they have a serious defect in that the printed images gradually blur with time. In addition, since the polyalkylene oxides have a property of forming spherulites, it was considered that the transparency of the resultant receiving layer is low and that they are unsuitable for the OHP sheets. According to the present invention, however, the problems of the polyalkylene oxides are solved by using a specific water-soluble resin in combination with a polyalkylene oxide compatible with the resin. The present invention has been completed on the basis of the above-described findings.

Namely, the present invention relates to a process for producing an ink-jet recording sheet, which comprises applying to a base sheet, an aqueous solution of one or more water-soluble resins selected from the group consisting of polyvinyl alcohol, polyvinyl pyrrolidone, polyacrylamide, polyacryloyl morpholine, water-soluble polyvinyl acetal, poly-N-vinyl acetamide, hydroxyethyl cellulose, hydroxypropyl cellulose, methyl cellulose, hydroxypropyl methyl cellulose, hydroxyethyl methyl cellulose, gelatin, casein and derivatives of them, irradiating the resultant coating layer with electron beam before the layer is not dried, to form a hydrogel, and drying the hydrogel.

The present invention also relates to the above-described process wherein the water-soluble resin is used in combination with a polyalkylene oxide compatible with the resin.

PREFERRED MODE OF THE INVENTION

The detailed description will be made on the present invention.

The water-soluble resins usable in the present invention are those free from a radical-polymerizable unsaturated bond and each capable of forming a hydrogel when it is irradiated with electron beam in the form of an aqueous solution thereof.

Supposedly the possibility of the formation of the hydrogel by the irradiation of the aqueous solution of the water-soluble resin with electron beam depends on the molecular structure of the resin. However, no rule on the formation thereof has been found yet. Among the water-soluble resins capable of forming the hydrogel, those excellent in the ink-jet recording property and water resistance and substantially free from "blurring" of the ink are as follows: polyvinyl alcohol, polyvinyl pyrrolidone, polyacrylamide, polyacryloyl morpholine, water-soluble polyvinyl acetal, poly-N-vinyl acetamide, hydroxyethyl cellulose, hydroxypropyl cellulose, methyl cellulose, hydroxypropyl methyl cellulose, hydroxyethyl methyl cellulose, gelatin, casein and derivatives of them. These water-soluble resins are usable either alone or in the form of a mixture of two or more of them.

The derivatives of the water-soluble resins, which are not particularly limited, include derivatives obtained by the copolymerization or graft polymerization of monomers; derivatives obtained by converting the hydroxyl group, amino group, amide group or carboxyl group of the resins into an ether, ester, amide, acetal, quaternary amino or cationic group; and derivatives obtained by partially cross-linking them with a cross-linking agent. Water-soluble cationic resins are particularly preferred for the following reasons: A dye in the ink electrostatically reacts with the cationic group and is fixed in the water-soluble cationic resin and, therefore, the setoff of the paper is only slight and even when the paper is immersed in water, the dye is not eluted in water. The water-soluble cationic resins include, for example, cationic polyvinyl alcohol, cationic polyvinyl pyrrolidone, cationic polyacrylamide, cationic polyacryloyl morpholine, water-soluble cationic polyvinyl acetal, cationic poly-N-vinylacetamide, cationic hydroxyethyl cellulose, cationic hydroxypropyl cellulose, cationic methyl cellulose, cationic hydroxypropyl methyl cellulose and cationic hydroxyethyl methyl cellulose. These resins are compatible with the polyalkylene oxides which are used if necessary in the aqueous solution. They are difficult to cause phase separation in the aqueous solution. Therefore, the receiving layers obtained after the irradiation with electron beam and drying are homogeneous and highly transparent.

The preferred weight-average molecular weight of the water-soluble resin or derivative thereof used in the present invention, which varies depending on the kind of the polymer, is usually in the range of, for example, 10,000 to 1,000,000, preferably 40,000 to 800,000.

The polyvinyl alcohol and cationic polyvinyl alcohol are preferably used in the present invention, taking advantage of a high ink absorbency thereof. The degree of saponification of them is very important because, when it is high, the ink is not absorbed because of the crystallization. Preferred polyvinyl alcohol or cationic polyvinyl alcohol are those easily soluble in cold water and partially saponified. The degree of saponification is desirably 70 to 91%, particularly 73 to 88%. Some of the water-soluble resins do not form the hydrogel even when the quantity of the electron beam is increased. They are, for example, polyvinyl methyl ether, polyethyleneimine, carboxymethyl cellulose and chitosan.

The water-soluble resin is contained in the aqueous solution usually in an amount of 2 to 50% by weight, preferably 3 to 30% by weight. The aqueous solution may contain an organic solvent such as ethyl alcohol, and the like together with water so long as the object of the present invention is not substantially affected.

In the present invention, a polyalkylene oxide can be incorporated into the above-described water-soluble resins.

Although the polyalkylene oxides usable herein are not particularly limited, it is suitable that they have a weight-average molecular weight of 20,000 to 2,000,000, preferably 100,000 to 1,000,000. When the weight-average molecular weight is insufficient, the water resistance of the ink-jet receiving layer inclines to be poor and the sherulites easily grow large. As a result, the transparency of the receiving layer is reduced and the gloss thereof inclines to be poor. On the contrary, when the weight-average molecular weight is excessive, the viscosity of the aqueous solution is very high to make the application difficult.

Preferred polyalkylene oxide includes polyethylene oxide, polyropylene oxide and ethylene oxide/propylene oxide copolymer. The polyalkylene oxide includes those obtained by reacting a polycarboxylic acid, anhydride thereof or a lower alkyl ester thereof or a diisocyanate. Preferred polyalkylene oxide includes polyethylene oxide.

In the present invention, a polyalkylene oxide is usable in combination with the water-soluble resin in such an amount that the aqueous solution does not cause phase separation. Therefore, the water-soluble resins compatible with the polyalkylene oxide are particularly preferably used.

The water-soluble resins compatible with the polyalkylene oxides are, for example, cationic polyvinyl alcohol, cationic polyvinyl pyrrolidone, cationic polyacrylamide, cationic hydroxyethyl cellulose, cationic methyl cellulose, cationic hydroxypropyl methyl cellulose, gelatin, casein and water-soluble derivatives of them. These water-soluble resins are usable either alone or in the form of a mixture of two or more of them with the polyalkylene oxide.

Among these water-soluble resins, the cationic resins are advantageous in the ink-drying property and water resistance because they have a high function of fixing the dye in the ink. Further, the cationic polyvinyl alcohols are preferably used in the present invention because of a high ink absorbency thereof.

The water-soluble derivatives of the above-described water-soluble resins are not particularly limited. Examples of them include derivatives obtained by copolymerizing or graft-polymerizing various monomers; derivatives obtained by etherifying, esterifying, amidating or acetalizing a hydroxyl group, amino group, amido group or carboxyl group of the resins; and derivatives obtained by partially cross-linking the resins with a cross-linking agent.

In addition to the above-described water-soluble resins, some of anionic resins such as sodium polyacrylate satisfy the conditions for them. Namely, some of them are compatible with the polyalkylene oxides, do not have a radical-polymerizable unsaturated bond and are capable of forming a hydrogel by the irradiation of an aqueous solution of a mixture thereof with the polyalkylene oxide with electron beam. However, such anionic resins are not so suitable for use as the main component of the ink-receiving layer because they are lacking in the function of fixing the ink for the ink-jet printer which ink contains an acid dye or a direct dye.

The weight ratio of the polyalkylene oxide to the water-soluble resin is 5/95 to 60/40, preferably 10/90 to 50/50. When the relative amount of the polyalkylene oxide is less than 5% by weight, the effects of improving the image quality and reducing the ink-drying time are poor and, on the contrary, when it exceeds 60% by weight, the defect of the polyalkylene oxide used in the latest ink-jet printers which jets a large amount of the ink, i.e. "the blurring of the image with time" is caused unfavorably.

The aqueous coating solution containing the above-described water-soluble resin and, if desired, the polyalkylene oxide can further contain various assistant materials, if necessary, so far as the characteristics of the components and the compatibility of the components with each other are not impaired. For example, it is particularly preferred to incorporate various cationic substances such as cationic resins and alumina sol for the purposes of insolubilizing the dye in the ink and fixing the dye in the ink-receiving layer. A defoaming agent can be mixed therein to improve the workability in the course of the application; a surfactant can be incorporated thereinto to improve the wettability of the plastic film, thereby to obtain the uniform ink-receiving layer; and starch or synthetic resin particles can be mixed therein to prevent the blocking of the sheets and to improve the paper-passing effect of the printer.

Further, fine particles which do not impair the transparency, such as colloidal silica, colloidal alumina, an emulsion or a latex can be mixed therein. When the intended product is not OHP sheets and the ink-receiving layer can be opaque, various inorganic or organic fillers or pigments can be incorporated into the solution. The fillers and the pigments are, for example, silica, alumina, alumina hydroxide, clay, talk, calcium carbonate, titanium dioxide, zeolite, zinc oxide and barium sulfate. With them, the ink-absorbency can be further improved or the gloss of the surface can be controlled.

The base sheet is desirably a plastic film having a high transparency when a light-transmitting recording medium such as OHP sheet is to be produced. Such plastic films are, for example, polyethylene terephthalate, polyvinyl chloride, polycarbonate, polyimide, cellulose triacetate, cellulose diacetate, polyethylene and polypropylene films.

For producing recording media other than the OHP sheets, the base sheets may be opaque materials such as wood-free paper, medium-quality paper, coated paper, art paper, cast-coated paper, paperboard, synthetic resin-laminated paper, metalized paper, synthetic paper and white films. The recording layer of the present invention realizes a high color density because of its high transparency and is capable of forming ink-jet recording sheets having an excellent gloss.

When the adhesion of the base sheet to the ink-receiving layer formed on the surface thereof is insufficient, an under-coating layer can be formed or various treatments for facilitating the adhesion such as corona discharge treatment are possible.

Taking the paper-passing function of the printer into consideration, the thickness of the base sheet is, for example, 50 to 500 $\mu$m, preferably 60 to 300 $\mu$m.

The aqueous resin solution can be applied to the base sheet by a well-known coating technique such as bar coating method, roll coating method, blade coating method, air-knife coating method, gravure coating method, die coating method and curtain coating method.

The quantity of the coating is desirably about 1 to 50 $g/m^2$, more desirably 3 to 20 $g/m^2$ after drying. When it is less than 1 $g/m^2$, the absorption of the ink will be insufficient and, on the contrary, when it exceeds 50 $g/m^2$, the curling will easily occur and the cost is increased undesirably.

The irradiation with electron beam is conducted by, for example, scanning method, curtain beam method or broad beam method. The acceleration voltage in the irradiation with electron beam is about 100 to 300 kV. The dose of the electron beam in the irradiation is preferably 0.1 to 20 Mrad, particularly in the range of 2 to 10 Mrad. A dose less than 0.1 Mrad is insufficient for the formation of the hydrogel and, on the contrary, the irradiation of more than 20 Mrad would cause the coloring of the water-soluble resin and the deterioration of the base unfavorably.

In the present invention, the aqueous solution of the specific water-soluble resin is applied to the base sheet and then irradiated with the electron beam without drying the solution. By the action of the electron beam, the cross-linking reaction of the water-soluble resin occurs in the wet state to form a non-fluid jelly-like, hydrogel. When the hydrogel is dried, the ink-receiving layer having a high water resistance and capable of realizing an image of a high quality is formed.

The concentration of the water-soluble resin at the time of the irradiation with the electron beam is important. It is, for example, 2 to 50% by weight, preferably 3 to 30% by weight. It is a necessary condition for the formation of the hydrogel that the molecules of the water-soluble resin are in contact with one another. Accordingly, the higher the concentration or the higher the molecular weight, the higher the degree of the overlapping of the polymer chains and the easier the formation of the hydrogel. A concentration of lower than 2% by weight is actually unsuitable because the hydrogel cannot be easily formed unless the water-soluble resin has a very high molecular weight and even when the hydrogel is formed, a large amount of the aqueous solution of the water-soluble resin must be applied to obtain the layer in an amount necessary for the absorption of the ink and, as a result, a large amount of water must be evaporated. On the contrary, when the concentration is excessive, the image quality will be low.

The mechanism of the formation of the ink-receiving layer excellent in water resistance and capable of realizing excellent ink-drying property and image quality in the present invention is considered to be as follows: Although it is an ordinary technique to incorporate a cross-linking agent in the water-soluble high-molecular substance used for forming the ink-receiving layer and then to heat the resultant mixture to conduct the cross-linking to improve the water resistance. However, as described above, the obtained receiving layer becomes not to absorb the ink and the image quality is seriously lowered. It is supposed that this phenomenon is caused because the cross-linking reaction of the water-soluble high-molecular substance with the cross-linking agent occurs in the water-free, dry coating film. Since the reaction of the cross-linking agent practically proceeds only at a high temperature, an aqueous solution of a mixture of the water-soluble high-molecular substance and the cross-linking agent is applied to the base sheet and then the sheet is passed through a dryer at a high temperature to evaporate water and then to carry out the cross-linking reaction. It is considered that the molecules of the high-molecular substance are in a spread form in the aqueous solution, but they are shrunk and intertwine to form a complicated structure and, in some kinds of the high-molecular substance, the molecules are partially crystallized in a water-free, dry state. The cross-linking in the dry state causes so-called "fixation" of the shrunk, intertwined, partially crystallized state. After once fixing this state, the spread form of the molecules can be no more recovered even by bringing the molecules into contact with water and, therefore, the aqueous ink cannot be absorbed and the obtained image quality will be poor. On the other hand, it is also supposed that in the present invention wherein the cross-linking occurs while the high-molecular chains are spread in the aqueous solution, the molecular form in the aqueous solution is "fixed" and when the molecules are brought into contact with water after drying, the molecules rapidly absorb water so as to recover the original state of the aqueous solution. It is considered, therefore, that the network structure of the ink-receiving layer of the present invention is different from that of the layer formed with an ordinary cross-linking agent.

When the polyalkylene oxide is used together with the water-soluble resin, it is supposed that not only the cross-linkage of the molecules of the resin or the cross-linkage of those of the polyalkylene oxide but also the cross-linkage between the molecules of the water-soluble resin and those of the polyalkylene oxide occurs. Since the water-soluble resin and the polyalkylene oxide are considered to be integrated in one body by the irradiation of the aqueous solution thereof with the electron beam, the phase separation of the polyalkylene oxide or the formation of the spherulites become impossible after the drying. Thus, the receiving layer of a high transparency is obtained.

EXAMPLES

The following Examples will further illustrate the present invention, which by no means limit the scope of the present invention.

Example 1

360 g of water was fed into a 1-liter beaker. 40 g of a cationic polyvinyl alcohol (CM-318; a product of Kuraray Co., Ltd.) having a degree of saponification of 86.0 to 91.0% and a degree of polymerization of 1800 was added thereto, and the resultant mixture was slowly stirred at room temperature to obtain a homogeneous 10% aqueous solution.

The obtained aqueous solution of the cationic polyvinyl alcohol was applied to a transparent polyethylene terephthalate film (Lumirror 100-Q80D; a product of Toray Industries, Inc.) having a thickness of 100 $\mu$m by bar-coating method so that the dry coating weight would be 10 $g/m^2$. Immediately thereafter, the film was irradiated, without being dried, with 5 Mrad of electron beam with an electron beam irradiation device (Electro-curtain; a product of ESI) under an acceleration voltage of 175 kV. When the surface of the coated film was touched with a finger after the irradiation, it was found that the aqueous cationic polyvinyl alcohol solution was solidified to form a jelly-like, i.e. a hydrogel. After drying at a temperature of 130° C., an ink-jet recording sheet was obtained.

The water resistance, image quality and drying property of the ink-jet recording sheet were tested by methods described below. The results are shown in Table 1. The transparency of the ink-jet recording sheet was macroscopically evaluated to be excellent.

Test methods for water resistance, image quality and ink drying property of receiving layer:

<Water resistance of receiving layer>

1 ml of water was dropped onto the surface of a test sheet, and the surface was strongly rubbed with a finger. The time necessitated for removing the coating to expose the base sheet surface was counted. The results were classified into the following five ranks:

Point

5: 5 minutes or longer

4: 2 minutes to shorter than 5 minutes

3: 10 seconds to shorter than 2 minutes

2: shorter than 10 seconds

1: water soluble.

<Image quality>

Solid printing (exclusive OHP sheet printing mode) was conducted on a test sheet with an ink-jet printer (PM 700C; a product of EPSON) in cyan, magenta, yellow and black colors. The uniformity of the print density was macroscopically divided into the following 5 ranks:

Point:

5: There is practically no unevenness in the density.

4: Unevenness in the density was only slight.

3: Unevenness in the density was moderate.

2: Unevenness in the density was serious.

1: Ink was repelled.

<Ink-drying property>

Solid printing (exclusive OHP sheet printing mode) was conducted on a test sheet with an ink-jet printer (PM 700C; a product of EPSON) in cyan, magenta, yellow and black colors. A sheet of PPC paper was pressed thereon by hand, and degree of the transfer of the ink was examined. The time necessitated until the ink had become no more transferred was measured. The average time for each color was calculated. The results were macroscopically divided into the following 5 ranks:

5: Shorter than 1 minute

4: 1 minute to shorter than 3 minutes

3: 3 minutes to shorter than 5 minutes

2: 5 minutes to shorter than 10 minutes

1: 10 minutes or longer.

Example 2

360 g of water was fed into a 1-liter beaker. 40 g of a polyvinyl alcohol (PVA-420; a product of Kuraray Co., Ltd.) having a degree of saponification of 78.0 to 81.0% and a degree of polymerization of 2000 was added thereto, and the resultant mixture was slowly stirred at room temperature to obtain a homogeneous 10% aqueous solution.

The obtained aqueous solution of the polyvinyl alcohol was applied to a transparent polyethylene terephthalate film having a thickness of 100 $\mu$m by bar-coating method so that the dry coating weight would be 10 g/m$^2$. Immediately thereafter, the film was irradiated, without being dried, with 5 Mrad of electron beam under an acceleration voltage of 175 kV in the same manner as that of Example 1. The aqueous polyvinyl alcohol solution was thus solidified to form a jelly-like hydrogel. After drying at a temperature of 130° C., an ink-jet recording sheet was obtained.

The water resistance, image quality and drying property of the ink-jet recording sheet were tested. The results are shown in Table 1. The transparency of the ink-jet recording sheet was macroscopically evaluated to be high.

Example 3

50 g of water was added to 150 g of a 20% aqueous solution of a cationic polyvinyl pyrrolidone [Luviquat HM 552 (vinylimidazolium methochloride/vinyl pyrrolidone copolymer having a molecular weight of 800,000); a product of BASF Japan], and the resultant mixture was slowly stirred at room temperature to dilute the solution to a concentration of 15%.

The obtained aqueous solution of the cationic polyvinyl pyrrolidone was applied to a transparent polyethylene terephthalate film having a thickness of 100 $\mu$m by bar-coating method so that the dry coating weight would be 10 g/m$^2$. Immediately thereafter, the film was irradiated, without being dried, with 5 Mrad of electron beam under an acceleration voltage of 175 kV in the same manner as that of Example 1. The aqueous cationic polyvinyl pyrrolidone solution was in the form of a jelly-like hydrogel. After drying at a temperature of 130° C., an ink-jet recording sheet was obtained.

The water resistance, image quality and drying property of the ink-jet recording sheet were tested. The results are shown in Table 1. The transparency of the ink-jet recording sheet was macroscopically evaluated to be high.

Example 4

360 g of water was fed into a 1-liter beaker. Polyvinyl pyrrolidone (a product of Wako Pure Chemical Industries, Ltd.; molecular weight: 360,000) was added thereto, and the resultant mixture was slowly stirred at room temperature to obtain a 10% homogeneous 10% aqueous solution.

The obtained aqueous solution of the polyvinyl pyrrolidone was applied to a transparent polyethylene terephthalate film having a thickness of 100 $\mu$m by bar-coating method so that the dry coating weight would be 10 g/m$^2$. Immediately thereafter, the film was irradiated, without being dried, with 5 Mrad of electron beam under an acceleration voltage of 175 kV in the same manner as that of Example 1. The aqueous polyvinyl pyrrolidone solution was thus solidified to form a jelly-like hydrogel. After drying at a temperature of 130° C., an ink-jet recording sheet was obtained.

The water resistance, image quality and drying property of the ink-jet recording sheet were tested. The results are shown in Table 1. The transparency of the ink-jet recording sheet was macroscopically evaluated to be high.

Example 5

348 g of water was fed into a 1-liter beaker, and 52 g of gelatin (alkali-treated gelatin P487; a product of Miyagi Kagaku Kogyo) was added thereto, and the resultant mixture was slowly stirred at 80° C. to dilute the solution to a concentration of 13%.

The obtained 80° C. aqueous gelatin solution was applied to a transparent polyethylene terephthalate film having a thickness of 100 $\mu$m by bar-coating method so that the dry weight would be 10 g/m$^2$. Immediately thereafter, the film was irradiated, without being dried, with 5 Mrad of electron beam under an acceleration voltage of 175 kV in the same manner as that of Example 1. The aqueous gelatin solution was in the form of an agar-like hydrogel. After drying at a temperature of 130° C., an ink-jet recording sheet was obtained.

The water resistance, image quality and drying property of the ink-jet recording sheet were tested. The results are shown in Table 1. The transparency of the ink-jet recording sheet was macroscopically evaluated to be high.

Example 6

65 g of water was fed into a 1-liter beaker, and 30 g of casein (a product of Wako Pure Chemical Industries, Ltd.)

was added thereto, and the resultant mixture was slowly stirred at room temperature for 20 minutes. Then, 65 g of water and 6 g of 28% ammonia water were added to the resultant mixture. The mixture was heated to 70° C. under stirring in a water bath. The stirring was continued until a homogeneous solution was obtained. 34 g of water was added to the homogeneous solution to dilute the solution to a concentration of 15%.

The obtained aqueous casein solution was applied to a transparent polyethylene terephthalate film having a thickness of 100 $\mu$m by bar-coating method so that the dry weight would be 10 g/m$^2$. Immediately thereafter, the film was irradiated, without being dried, with 5 Mrad of electron beam under an acceleration voltage of 175 kV in the same manner as that of Example 1. After the irradiation with the electron beam, the aqueous casein solution was in the form of a jelly-like hydrogel. After drying at a temperature of 130° C., an ink-jet recording sheet was obtained.

The water resistance, image quality and drying property of the ink-jet recording sheet were tested. The results are shown in Table 1. The transparency of the ink-jet recording sheet was macroscopically evaluated to be high.

Comparative Examples 1 to 6

After the application of the water-soluble resin followed by drying at 130° C., the film was irradiated with 5 Mrad of electron beam under an acceleration voltage of 175 kV to obtain samples of Comparative Examples 1 to 6.

The water resistance, image quality and drying property of the ink-jet recording sheet were tested. The results are shown in Table 1.

Comparative Example 7

360 g of water was fed into a 1-liter beaker, and 40 g of carboxymethyl cellulose (Cellogen 7A; product of Dai-ichi Kogyo Seiyaku Co., Ltd.) was added thereto, and the resultant mixture was slowly stirred at room temperature to obtain a homogeneous aqueous solution having a concentration of 10%.

Then, the obtained aqueous carboxymethyl cellulose solution was applied to a transparent polyethylene terephthalate film having a thickness of 100 $\mu$m by bar-coating method so that the dry coating weight would be 10 g/m$^2$. Immediately thereafter, the film was irradiated, without being dried, with 10 Mrad of electron beam under an acceleration voltage of 175 kV. The surface of the irradiated coated film was touched with a finger to find that it was still in liquid form and not converted into hydrogel. After drying at a temperature of 130° C., a product of Comparative Example 7 was obtained.

The water resistance, image quality and drying property of the ink-jet recording sheet were tested. The results are shown in Table 1.

Comparative Example 8

100 g of the same 10% aqueous solution of cationic polyvinyl alcohol (CM318; a product of Kuraray Co., Ltd.) as that used in Example 1 was mixed with 0.444 g (2% based on PVA) of Sumirez Resin 5004 (concentration: 45%) as a water-resisting agent (cross-linking agent). The obtained mixture was applied to a transparent polyethylene terephthalate film by bar-coating method so that the dry coating weight would be 10 g/m$^2$. After drying at a temperature of 130° C. and simultaneous cross-linkage, an ink-jet recording sheet was obtained.

The water resistance, image quality and drying property of the ink-jet recording sheet were tested. The results are shown in Table 1.

TABLE 1

| | Ink-receiving layer formation method | | | Quality (5 grades) | | |
|---|---|---|---|---|---|---|
| | Water-soluble resin | Water-soluble resin conc. during irradiation with electron beam (wt. %) | Hydrogel formation | Water resistance of receiving layer | Image quality | Drying property |
| Ex.1 | cationic polyvinyl alcohol | 10 | yes | 5 | 4 | 4 |
| Ex.2 | polyvinyl alcohol | 10 | " | 5 | 4 | 3 |
| Ex.3 | cationic polyvinyl pyrrolidone | 15 | " | 5 | 4 | 4 |
| Ex.4 | polyvinyl pyrrolidone | 10 | " | 5 | 4 | 3 |
| Ex.5 | gelatin | 13 | " | 3 | 3 | 2 |
| Ex.6 | casein | 15 | " | 3 | 3 | 2 |
| Comp. Ex.1 | cationic polyvinyl alcohol | 100 irradiation after drying | no | 1 | 4 | 3 |
| Comp. Ex.2 | polyvinyl alcohol | " | " | 1 | 4 | 3 |
| Comp. Ex.3 | cationic polyvinyl pyrrolidone | " | " | 1 | 4 | 3 |
| Comp. Ex4. | polyvinyl pyrrolidone | " | " | 1 | 4 | 3 |
| Comp. Ex.5 | gelatin | " | " | 1 | 3 | 2 |
| Comp. Ex.6 | casein | " | " | 1 | 3 | 2 |
| Comp. Ex.7 | carboxymethyl cellulose | 10 | " | 1 | 1 | 2 |
| Comp. Ex.8 | cationic polyvinyl alcohol | No irradiation with electron beam | " | 3 | 2 | 1 |

It is clear from the results of Examples 1 to 6 shown in Table 1 that when the aqueous solution containing the water-soluble resin is applied to the base sheet and then the applied solution not being dried, is irradiated with the electron beam to form the hydrogel which is then dried, the obtained product had an excellent water resistance and exhibited an excellent image quality and drying property and was usable as an ink-jet recording sheet of a high quality. Particularly when the water-soluble cationic resin was used as in Examples 1 and 3, the ink-drying property and quality were more excellent than that obtained when a water-soluble non-cationic resin was used (Examples 2 and 4).

On the contrary, when the irradiation of the electron beam is conducted after the drying as in Comparative Examples 1 to 6, the water-soluble resin was not insolubilized and could not have the water resistance. When a water-soluble resin which cannot form the hydrogel even by the irradiation with the electron beam was used as in Comparative Example 7, no water resistance was imparted even after the irradiation of the aqueous solution with the electron beam. When the cationic polyvinyl alcohol as used in Example 1 was cross-linked with an agent for making it water-resistant to improve the water resistance, the image quality and ink-drying property were seriously impaired (Comparative Example 8).

Example 7

85 g of water was fed into a 200 ml beaker. 15 g of a polyethylene oxide having a molecular weight of 150,000 to 400,000 (PEO-1; a product of Sumitomo Seika Chemicals Co., Ltd.) was added thereto and the resultant mixture was slowly stirred at room temperature to obtain a homogeneous 15% aqueous solution. Then, 85 g of water was fed into a 200 ml beaker. 15 g of a cationic polyvinyl alcohol (CM-318; a product of Kuraray Co., Ltd.) having a degree of saponification of 86.0 to 91.0 molar % and a degree of polymerization of 1800 was added to the obtained solution, and the resultant mixture was slowly stirred at room temperature to obtain a 15% aqueous solution.

20 g of the aqueous polyethylene oxide solution and 80 g of the aqueous cationic polyvinyl alcohol solution were fed into a 200 ml beaker and they were thoroughly mixed by rapid stirring to obtain an aqueous solution of a mixture of the polyethylene oxide and the cationic polyvinyl alcohol in a weight ratio of 20:80, which had the total concentration of 15%. One drop of the aqueous mixture solution was placed on a slide glass and observed with an optical microscope at X100 magnification (transmitted light) to confirm that the solution was homogeneous.

The obtained aqueous resin mixture solution was applied to a transparent polyethylene terephthalate film (Lumirror 100-Q80D; a product of Toray Industries, Inc.) having a thickness of 100 $\mu$m by bar-coating method so that the dry coating weight would be 10 g/m$^2$. Immediately thereafter, the film was irradiated, without being dried, with 5 Mrad of electron beam with an electron beam irradiation device (Electro-curtain; a product of ESI) under an acceleration voltage of 175 kV. The surface of the coated film was touched with a finger after the irradiation, to confirm that the aqueous resin mixture solution was solidified to form a jelly-like hydrogel. After drying at a temperature of 130° C., an ink-jet recording sheet was obtained.

The water resistance, the image quality and drying property of the ink-jet recording sheet were tested in the same manner as that described above. The haze of the ink-jet recording sheet was determined by the following test method. The results are shown in Table 2 given below.

<Haze>

The haze of the test sheet was determined with C light with a transmittance meter (HR-100; a product of Murakami Color Research Laboratory) (JIS K 7105).

Example 8

25 g of water was added to 75 g of a 20% aqueous solution of a cationic polyvinyl pyrrolidone [Luviquat HM 552 (vinylimidazolium methochloride/vinyl pyrrolidone copolymer having a molecular weight of 800,000); a product of BAFS Japan] in a 200 ml beaker. The resultant mixture was slowly stirred at room temperature to dilute it to a 15% aqueous solution.

30 g of the same 15% aqueous solution of polyethylene oxide having a molecular weight of 150,000 to 400,000 (PEO-1; a product of Sumitomo Seika Chemicals Co., Ltd.) as that used in Example 7 and 70 g of the aqueous cationic polyvinyl pyrrolidone solution were fed into a 200 ml beaker and they were thoroughly mixed by rapid stirring to obtain an aqueous solution of a mixture of the polyethylene oxide and the cationic polyvinyl pyrrolidone in a weight ratio of 30:70 and the total concentration of 15%. One drop of the aqueous mixture solution was placed on a slide glass and observed with an optical microscope at X100 magnification (transmitted light) to confirm that the solution was homogeneous.

The obtained aqueous resin mixture solution was applied to a transparent polyethylene terephthalate film having a thickness of 100 $\mu$m by bar-coating method so that the dry coating weight would be 10 g/m$^2$. Immediately thereafter, the film was irradiated, without being dried, with 5 Mrad of electron beam under an acceleration voltage of 175 kV in the same manner as that of Example 7. After the irradiation will electron beam, the aqueous resin mixture solution was solidified to form a jelly-like hydrogel. After drying at a temperature of 130° C., an ink-jet recording sheet was obtained.

The water resistance, image quality, drying property and haze of the ink-jet recording sheet were tested. The results are shown in Table 2.

Example 9

93 g of water was fed into a 200 ml beaker. 7 g of a polyethylene oxide having a molecular weight of 600,000 to 1,100,000 (PEO-3; a product of Sumitomo Seika Chemicals Co., Ltd.) was added thereto and the resultant mixture was slowly stirred at room temperature to obtain a homogeneous 7% aqueous solution.

40 g of the aqueous polyethylene oxide solution and 60 g of 7% aqueous solution of cationic polyvinyl acrylamide (POLYSTRON 619; a product of Arakawa Kagaku Kogyo Co., Ltd.) were fed into a 200 ml beaker and they were thoroughly mixed by rapid stirring to obtain an aqueous solution of a mixture of the polyethylene oxide and the cationic polyacrylamide in a weight ratio of 40:60, which had the total concentration of 7%. One drop of the aqueous mixture solution was placed on a slide glass and observed with an optical microscope at ×100 magnification (transmitted light) to confirm that the solution was homogeneous.

The obtained aqueous resin mixture solution was applied to a transparent polyethylene terephthalate film having a thickness of 100 $\mu$m by bar-coating method so that the dry coating weight would be 10 g/m$^2$. Immediately thereafter, the film was irradiated, without being dried, with 5 Mrad of electron beam under an acceleration voltage of 175 kV in the same manner as that of Example 7. After the irradiation with electron beam, the aqueous mixed resin solution was in the form a jelly-like hydrogel. After drying at a temperature of 130° C., an ink-jet recording sheet was obtained.

The water resistance, image quality, drying property and haze of the ink-jet recording sheet were tested. The results are shown in Table 2.

Example 10

65 g of water was fed into a 300 ml beaker. 30 g of casein (a product of Wako Pure Chemical Industries, Ltd.) was added thereto and the resultant mixture was slowly stirred at room temperature for 20 minutes. Then, 65 g of water and 6 g of 28% ammonia water were added to the resultant mixture The mixture was heated to 70° C. under stirring in a water bath. The stirring was continued until a homogeneous solution was obtained. 34 g of water was added to the homogeneous solution to obtain a 15% aqueous solution.

40 g of 15% aqueous solution of polyethylene oxide having a molecular weight of 150,000 to 400,000 (PEO-1; a product of Sumitomo Seika Chemicals Co., Ltd.) which was the same as that used in Example 7 and 60 g of the aqueous casein solution prepared as described above were fed into a 200 ml beaker and they were thoroughly mixed by rapid stirring to obtain an aqueous solution of a mixture of the polyethylene oxide and casein in a weight ratio of 40:60, which had the total concentration of 15%. One drop of the aqueous mixture solution was placed on a slide glass and observed with an optical microscope at ×100 magnification (transmitted light) to confirm that the solution was homogeneous.

The obtained aqueous resin mixture solution was applied to a transparent polyethylene terephthalate film having a thickness of 100 μm by bar-coating method so that the dry weight would be 10 g/m$^2$. Immediately thereafter, the film was irradiated, without being dried, with 5 Mrad of electron beam under an acceleration voltage of 175 kV in the same manner as that of Example 7. After the irradiation with electron beam, the aqueous mixed resin solution was in the form a jelly-like hydrogel. After drying at a temperature of 130° C., an ink-jet recording sheet was obtained.

The water resistance, image quality, drying property and haze of the ink-jet recording sheet were tested. The results are shown in Table 2.

Comparative Examples 9 to 12

After the application of the water-soluble resin followed by drying at 130° C. in the same manner as that of Examples 7 to 10, the film was irradiated with 5 Mrad of electron beam under an acceleration voltage of 175 kV to obtain samples of Comparative Examples 9 to 12.

The water resistance, image quality, drying property and haze of the ink-jet recording sheet were tested. The results are shown in Table 2.

Comparative Example 13

15% aqueous solution of the same polyethylene oxide having a molecular weight of 150,000 to 400,000 (PEO-1; a product of Sumitomo Seika Chemicals Co., Ltd.) as that used in Example 7 was applied to a transparent polyethylene terephthalate film having a thickness of 100 μm by bar-coating method so that the dry coating weight would be 10 g/m$^2$. Immediately thereafter, the film was irradiated, without being dried, with 5 Mrad of electron beam under an acceleration voltage of 175 kV. After the irradiation with electron beam, the aqueous mixed resin solution was in the form a jelly-like hydrogel. After drying at a temperature of 130° C., an ink-jet recording sheet of Comparative Example 13 was obtained.

The water resistance, image quality, drying property and haze of the ink-jet recording sheet were tested. The results are shown in Table 2.

Comparative Example 14

100 g of the aqueous solution of the mixture of polyethylene oxide and cationic polyvinyl alcohol in a weight ratio of 20:80, which had a total concentration of 15% and which was the same as that used in Example 7, was mixed with 1.875 g (6.25% based on cationic PVA) of a glyoxal solution (concentration: 40%) (a product of Wako Pure Chemical Industries, Ltd.) as an agent for making water resistant (cross-linking agent). The obtained mixture was applied to a transparent polyethylene terephthalate film having a thickness of 100 μm by bar-coating method so that the dry coating weight would be 10 g/m$^2$ in the same manner as that of Example 7. After drying at a temperature of 130° C. and crosslinking, an ink-jet recording sheet of Comparative Example 14 was obtained.

The water resistance, image quality, drying property and haze of the ink-jet recording sheet were tested. The results are shown in Table 2.

TABLE 2

| | Ink-receiving layer formation method | | | Quality(5 grades) | | | |
|---|---|---|---|---|---|---|---|
| | Water-soluble resin | Water-soluble resin conc. during irradiation with electron beam(wt. %) | Hydrogel formation | Water resistance of receiving layer | Image quality | Drying property | Haze of coating layer (%) |
| Ex.7 | PE01/ cationic PVA (2/8) | 15 | yes | 5 | 5 | 5 | 3.0 |
| Ex.8 | PE01/ cationic PVP (3/7) | 15 | " | 5 | 5 | 5 | 4.0 |
| Ex.9 | PE03/ cationic PAM (4/6) | 7 | " | 5 | 4 | 5 | 4.4 |
| Ex.10 | PE01 casein (4/6) | 15 | " | 4 | 5 | 4 | 4.3 |
| Comp Ex.9 | PE01/ cationic PVA (2/8) | 100(irradiation after dying) | no | 1 | 3 | 3 | 5.9 |
| Comp. Ex.10 | PE01/ cationic PVP (3/7) | " | " | 1 | 2 | 1 | 9.5 |
| Comp. Ex.11 | PE03/ cationic PAM (4/6) | " | " | 1 | 2 | 1 | 58.6 |
| Comp. Ex.12 | PE01/ casein (4/6) | " | " | 1 | 2 | 2 | 6.8 |
| Comp. Ex.13 | PE01 | 15 | yes | 5 | 3 | 5 | 14.3 |
| Comp. Ex.14 | PE01/ cationic PVA (2/8) | crosslinking agent added | — | 3 | 1 | 2 | 12.1 |

It is clear from the results of Examples 7 to 10 shown in Table 2 that by the process which comprises mixing the polyalkylene oxide with the water-soluble resin compatible with the polyalkylene oxide, then applying the obtained aqueous solution to the base sheet and, without drying, irradiating the sheet with electron beam to form the hydrogel and drying the coated sheet, the obtained ink-jet recording sheet has a very high quality, namely, it has an excellent water resistance and also realizes excellent image quality and drying property. When a cationic resin is used as the water-soluble resin to be mixed with the polyalkylene oxide as in Examples 7 to 9, the ink-drying property and the quality are better than those obtained when a non-cationic water-soluble resin was used (Example 10).

When an aqueous solution of a mixture of the polyethylene oxide used in Examples 7 to 10 with a specific water-soluble resin was applied to a base sheet and the irradiation was conducted after drying, the coating was still soluble in water and had no water resistance. In addition, since the phase separation of the polyethylene oxide from the specific water-soluble resin proceeds in the drying step, the transparency of the sheet was reduced (Comparative Examples 9 to 12).

When polyethylene oxide was used alone, water resistance was realized. However, when polyethylene oxide was used alone, the blurring occurred with time (Comparative Example 13).

When the cationic polyvinyl alcohol in the mixture of the polyethylene oxide and the cationic polyvinyl alcohol used in Example 1 was cross-linked with an agent for making it water-resistant to increase the water resistance, the image quality and ink drying property were seriously impaired (Comparative Example 14).

When the polyalkylene oxide is also used, a water-soluble resin compatible with it should be used. When an incompatible resin is used, the phase separation is caused in the aqueous solution to make the coating uneven and, in addition, the transparency, gloss and water resistance of the recording sheet for the ink-jet printer are easily lowered.

The recording sheet for the ink-jet printer, of the present invention, has excellent water resistance and high transparency and realizes excellent ink-drying property and image quality and, therefore, it is suitable for use not only as the OHP sheet but also as ink-jet recording sheets in a wide range.

What is claimed is:

1. A process for producing an ink-jet recording sheet, which comprises the steps of:

(1) applying to a base sheet, an aqueous solution to prepare a coating layer on said base sheet, said aqueous solution being comprised of:

(i) a polyalkylene oxide; and (ii) a water-soluble resin having no radically polymerizable double bond and compatible with said polyalkylene oxide and selected from the group consisting of cationic polyvinyl alcohol, cationic polyvinyl pyrrolidone, cationic polyacrylamide, cationic polyacryloyl morpholine, cationic polyvinyl acetal, cationic poly-N-vinyl acetamide, cationic hydroxyethyl cellulose, cationic hydroxypropyl cellulose, cationic methyl cellulose, cationic hydroxypropyl methyl cellulose, cationic hydroxyethyl methyl cellulose, gelatin and casein;

(2) irradiating said coating layer with electron beam while it is wet, to form a hydrogel; and (3) drying said hydrogel.

2. The process of claim 1, wherein said water-soluble resin is cationic polyvinyl alcohol.

3. The process of claim 1, wherein said water-soluble resin is contained in the aqueous solution in an amount of 2 to 50% by weight.

4. The process of claim 1, wherein said water-soluble resin has a weight-average molecular weight of 10,000 to 1,000,000.

5. The process of claim 2, wherein said water-soluble resin has a degree of saponification of 70 to 91%.

6. The process of claim 1, wherein the dose of the electron beam in the irradiation is 0.1 to 20 Mrad.

7. The process of claim 1, wherein said polyalkylene oxide has a weight-average molecular weight of 20,000 to 2,000,000.

8. The process of claim 7, wherein said polyalkylene oxide has a weight-average molecular weight of 100,000 to 1,000,000.

9. The process of claim 1, wherein said polyalkylene oxide is selected from the group consisting of polyethylene oxide, polypropylene oxide and ethylene oxide/propylene oxide copolymer.

10. The process of claim 9, wherein said polyalkylene oxide is polyethylene oxide.

11. The process of claim 1, wherein the weight ratio of said polyalkylene oxide to said water-soluble resin is 5/95 to 60/40.

12. The process of claim 1, wherein the weight ratio of said polyalkylene oxide to said water-soluble resin is 10/90 to 50/50.

13. The process of claim 3, wherein said coating layer to be irradiated contains said water-soluble resin in an amount of 3 to 30% by weight.

14. An ink-jet recording sheet produced by the process of claim 1 by using a transparent base sheet.

* * * * *